US011578876B2

(12) United States Patent
He et al.

(10) Patent No.: US 11,578,876 B2
(45) Date of Patent: Feb. 14, 2023

(54) DUAL-PURPOSE CIRCULATING PURIFIER

(71) Applicant: Shanghai Duohuan Oil-Smoke Purification Equipment Co., Ltd., Shanghai (CN)

(72) Inventors: Weibin He, Shanghai (CN); Yang He, Shanghai (CN); Min He, Shanghai (CN)

(73) Assignee: Shanghai Duohuan Oil-Smoke Purification Equipment Co., Ltd., Shanghai (CN)

( * ) Notice: Subject to any disclaimer, the term of this patent is extended or adjusted under 35 U.S.C. 154(b) by 494 days.

(21) Appl. No.: 16/633,252

(22) PCT Filed: May 23, 2018

(86) PCT No.: PCT/CN2018/087983
§ 371 (c)(1),
(2) Date: Jan. 23, 2020

(87) PCT Pub. No.: WO2019/037493
PCT Pub. Date: Feb. 28, 2019

(65) Prior Publication Data

US 2020/0173664 A1 Jun. 4, 2020

(30) Foreign Application Priority Data

Aug. 23, 2017 (CN) ..... 201710729954.X

(51) Int. Cl.
*F24C 15/20* (2006.01)
*F24F 7/007* (2006.01)
*F24F 13/28* (2006.01)

(52) U.S. Cl.
CPC ..... *F24C 15/2035* (2013.01); *F24C 15/2042* (2013.01); *F24F 7/007* (2013.01); *F24F 13/28* (2013.01); *F24F 2221/18* (2013.01)

(58) Field of Classification Search
CPC .. F24C 15/2035; F24C 15/2042; F24C 15/20; F24C 3/047; F24C 15/2071;
(Continued)

(56) References Cited

U.S. PATENT DOCUMENTS 3,698,378 A 10/1972 Rosenberg et al.
3,744,217 A * 7/1973 Ebert ..... C01B 13/11 96/48

(Continued)

FOREIGN PATENT DOCUMENTS

CN 2551896 Y 5/2003
CN 1766427 A 5/2006

(Continued)

*Primary Examiner* — Steven B McAllister
*Assistant Examiner* — Cole N Friedman
(74) *Attorney, Agent, or Firm* — Rimon PC

(57) ABSTRACT

The present invention relates to a dual-purpose circulating purifier, including a housing, an oil fume purification device, a fresh air supply device, and a double-wing baffle device, where the oil fume purification device includes a fume suction opening, a first air outlet, a grease separator, a fume suction cavity, a first fan, a fume purification chamber, and a fume purification filter layer; the fresh air supply device includes an air suction opening, a second air outlet, a dust blocker, an air suction cavity, a second fan, a gas purification chamber, and a gas purification filter layer; and the double-wing baffle device includes a first baffle and a second baffle. The dual-purpose circulating purifier can purify indoor oil fumes, and also provide purified fresh air to the indoors, greatly improving air quality.

9 Claims, 2 Drawing Sheets

(58) Field of Classification Search
CPC ..... F24C 15/027; F24C 15/2092; F24F 7/007; F24F 13/28; F24F 2221/18; F24F 2013/0616; F24F 7/06; F24F 12/002; F24F 12/001; F24F 7/08; Y10S 55/36; Y10S 165/909; B08B 15/02; F04D 25/166
USPC ..... 55/467, DIG. 36, 318; 126/299 D; 454/56
See application file for complete search history.

(56) References Cited

U.S. PATENT DOCUMENTS 4,089,327 A * 5/1978 Welsh ..... F24C 15/20 55/DIG. 36
4,122,834 A * 10/1978 Jacobs ..... F24C 15/20 55/DIG. 36
4,513,809 A * 4/1985 Schneider ..... F24F 12/001 165/909
4,759,196 A * 7/1988 Davis ..... F24F 1/0035 55/471
4,902,316 A * 2/1990 Giles, Sr. ..... A21B 1/48 55/467
5,220,955 A * 6/1993 Stokes ..... F04D 29/5826 165/122
5,626,820 A * 5/1997 Kinkead ..... F24F 3/167 55/318
5,662,097 A * 9/1997 Panos ..... F24C 15/2057 55/DIG. 36

FOREIGN PATENT DOCUMENTS

CN 2800110 Y 7/2006
CN 102410570 A 4/2012
CN 204128025 U 1/2015
CN 205536029 U 8/2016
CN 206291283 U 6/2017
CN 206291411 U 6/2017
JP 2000081216 A 3/2000

* cited by examiner

DUAL-PURPOSE CIRCULATING PURIFIER

RELATED APPLICATIONS

This application is a national stage application of PCT/CN2018/087983 filed May 23, 2018, which claims the benefit of priority from Chinese Application No. 201710729954.X filed Aug. 23, 2017, the disclosures of both applications being incorporated herein by reference in their entirety.

TECHNICAL FIELD

The present invention belongs to oil fume purification equipment in the new energy field, and relates to a dual-purpose circulating purifier for oil fumes.

BACKGROUND

Since the reform and opening-up, China's national economy has been developed rapidly, but the atmospheric environment on which people live is deteriorating seriously. The government has paid high costs for haze control, such as closing enterprises that emit large amount of pollutants, and adopting some other measures for air control, which has made some improvements. However, as one of sources of air pollution, kitchen/catering pollution emissions have not been fundamentally improved, which still troubles the society.

Due to the limitations of the prior art, the domestic commercial catering industry still uses an adapter-tube emptying technology adopted several decades ago for oil fume emission with low purification standards; and many enterprises in the catering industry did not do any purification work. Household cooking emissions are worse. There is no complete purification standard for existing extractor hoods, and a multi-storey shared fume channel is commonly used for centralized discharge of oil fume and exhaust air. There is evidence that in some large and medium-sized cities, air pollution caused by the oil fume emission has exceeded industrial pollution. Therefore, to resolve emissions of oil fume pollution for people living in cities is urgent for air control.

On another hand, existing pipe type oil fume emission has greatly increased construction costs of society and energy consumption of unit fume discharge product. Moreover, blocked fume discharge, fume backflow, fume channeling between adjacent storeys, and other common phenomena occurring on shared household fume channels directly affect an indoor living environment of people. Therefore, it is urgent to develop a dual-purpose circulating purifier to prevent oil fume emission from causing air pollution and effectively improve people's living environment.

SUMMARY

To overcome the above disadvantages in the prior art, the present invention provides a dual-purpose circulating purifier, which can not only purify indoor fume, but also provide purified fresh air to the indoors, and can also make use of waste heat generated during cooking.

The technical solution adopted by the present invention is as follows: a dual-purpose circulating purifier, including a housing, an oil fume purification device, a fresh air supply device, and a double-wing baffle device, where both the oil fume purification device and the fresh air supply device are arranged inside the housing; the oil fume purification device includes a fume suction opening, a first air outlet, a grease separator, a fume suction cavity, a first fan, a fume purification chamber, and a fume purification filter layer; the grease separator is disposed at the fume suction opening or inside the fume suction cavity, and the fume purification filter layer is disposed inside the fume purification chamber; the fresh air supply device includes an air suction opening, a second air outlet, a dust blocker, an air suction cavity, a second fan, a gas purification chamber, and a gas purification filter layer; the dust blocker is disposed at the air suction opening or inside the air suction cavity, and the gas purification filter layer is disposed inside the gas purification chamber; and the double-wing baffle device includes a first baffle and a second baffle, where an upper end of the first baffle can be rotatably fastened above the fume suction opening, and an upper end of the second baffle can be rotatably fastened above the air suction opening.

The fume suction opening is disposed on an inner side of a lower part of the housing; the first air outlet is disposed on an outer side of an upper part of the housing; the air suction opening is disposed on the lower part of the housing and on an outer side facing away from the fume suction opening; and the second air outlet is disposed on an inner side of the upper part of the housing.

The double-wing baffle device further includes a first push rod, a second push rod, a first motor, and a second motor; one end of the first push rod is connected to the first baffle; and one end of the second push rod is connected to the second baffle.

The double-wing baffle device further includes a first support rod, a second support rod, a first connecting rod, a second connecting rod, a first main drive rod, a first auxiliary drive rod, a second drive rod, a fixing seat, and a drive motor; one end of the first support rod is connected to the first baffle, and the other end thereof is connected to both one end of the first connecting rod and one end of the first auxiliary drive rod; the other end of the first connecting rod can be rotatably fastened to the fixing seat; the other end of the first auxiliary drive rod is connected to one end of the first main drive rod; the other end of the first main drive rod is connected to the drive motor; one end of the second support rod is connected to the second baffle, and the other end thereof is connected to the second drive rod; and one end of the second connecting rod can be rotatably fastened to the fixing seat, and the other end thereof is connected to the second support rod.

The dual-purpose circulating purifier further includes a heat exchange device, where the heat exchange device includes a heat absorber, a radiator, and a circulating pipeline; the heat absorber is arranged at a lower end of the circulating pipeline and located inside the fume suction cavity; and the radiator is arranged at an upper end of the circulating pipeline and located inside the fresh air supply device.

The heat exchange device further includes a booster pump, and the booster pump is connected to the circulating pipeline.

The fume suction cavity and the air suction cavity are integrally connected, and a partition plate is disposed therebetween.

The first fan and the second fan are respectively disposed on two sides of the partition plate.

The first fan and the second fan form a fan group; the fan group includes two volutes provided with wind wheels and a concentric motor with double output shafts that is shared by the two volutes; the two volutes are clamped on the partition plate; the motor is longitudinally disposed on the partition plate; and the output shafts at two ends of the motor are respectively connected to the wind wheels inside the two volutes.

The fume purification filter layer is one or a combination of several of an organic cotton filter mesh layer, a high efficiency HEPA mesh layer, an activated carbon filter layer, and nano photocatalyst $TiO_2$ layer; and the gas purification filter layer is one or a combination of several of an organic cotton filter mesh layer, a high efficiency HEPA mesh layer, an activated carbon filter layer, and nano photocatalyst $TiO_2$ layer.

The grease separator is any one of a mechanical grease separator, a radial multi-blade turnplate, and an electrostatic grease separator; the mechanical grease separator uses double layers of concave filter meshes, and respective concave surfaces of the filter meshes are oppositely buckled together; a center of the radial multi-blade turnplate is fastened to an end of the output shaft of the first fan; the electrostatic grease separator is of a structure including an electrostatic field and a grease contact absorption unit that are disposed inside the fume suction cavity; and the dust blocker is of a structure that is the same as that of any of the mechanical grease separator, the radial multi-blade turnplate, and the electrostatic grease separator.

The present invention has the following beneficial effects: (1) Oil fume purification and fresh air supply are organically combined to form an extractor hood product, thereby greatly improving the social environment and indoor air quality. (2) The present invention not only greatly reduces construction costs and increases a usable floor area of a house of a resident, but also provides fresh indoor air for people for a long time. (3) The present invention is used indoors where it is inconvenient to directly discharge oil fumes, and indoor fumes are treated through circulating purification to meet usage requirements of consumers in different occasions. (4) The present invention implements purification and emission without using a pipeline, reduces wind resistance and energy consumption during operation of a fan, thereby achieving energy conservation. (5) Double-wing baffles disposed in the present invention not only can enhance a fume absorption effect, but also can play a role of protection and prolong the service life of the product.

BRIEF DESCRIPTION OF THE DRAWINGS

To describe the technical solutions in the embodiments of the present invention or in the prior art more clearly, the following briefly describes the accompanying drawings required for describing the embodiments. Apparently, the accompanying drawings in the following description show merely some embodiments of the present invention, and a person of ordinary skill in the art may still derive other drawings from these accompanying drawings without creative efforts.

DETAILED DESCRIPTION

The following clearly and completely describes the technical solutions in the embodiments of the present invention with reference to accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

To make the above objects, features, and advantages of the present invention more obvious and easy to understand, the present invention is further described in detail with reference to the accompanying drawings and the detailed implementations.

Figure 1:
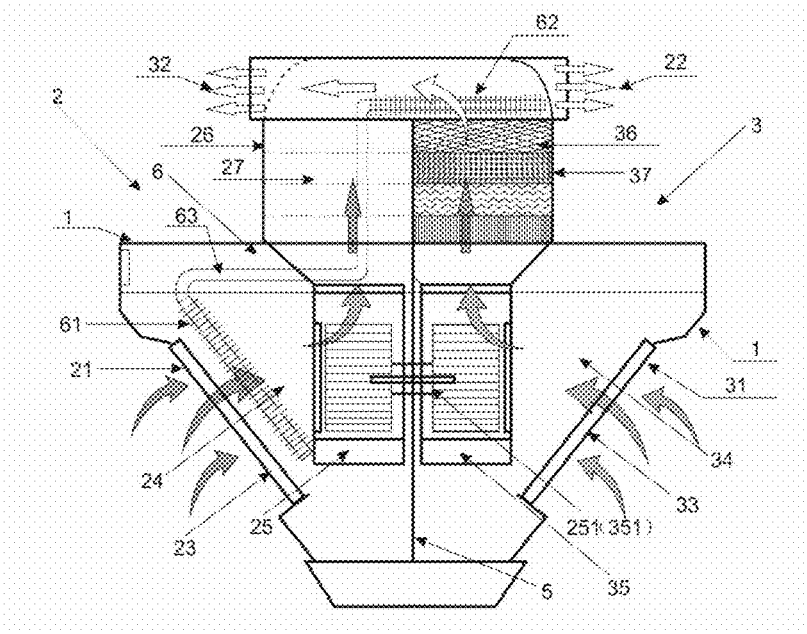
FIG. 1 is a schematic sectional side view of a dual-purpose circulating purifier according to the present invention.
Figure 2:
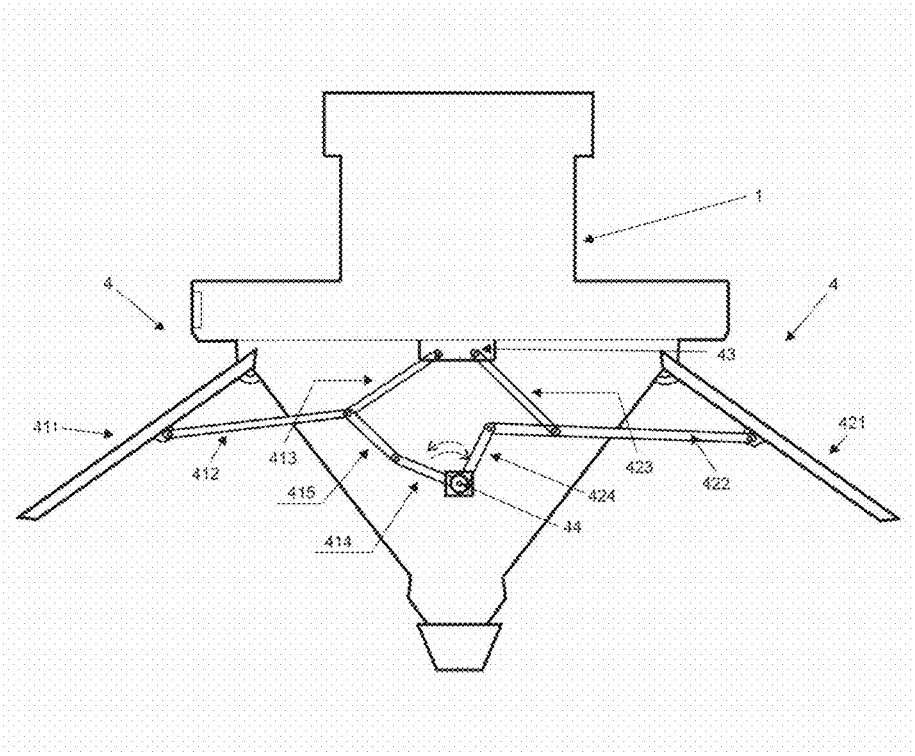
FIG. 2 is a schematic sectional side view of a double-wing baffle device according to the present invention.
Figure 3:
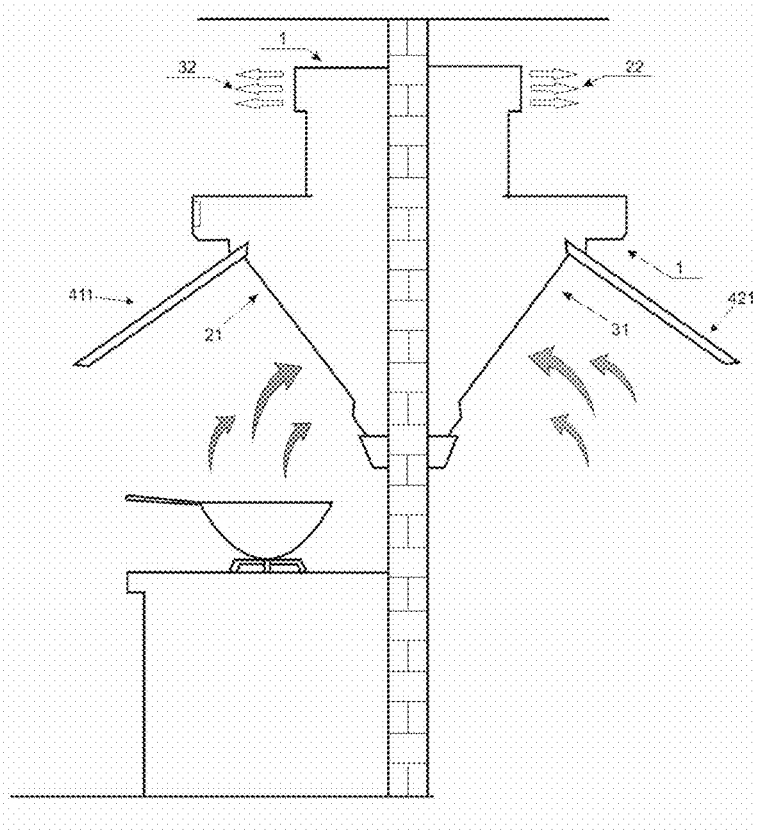
FIG. 3 is a side view of a dual-purpose circulating purifier installed in a window form according to the present invention.

As shown in FIG. 1 to FIG. 3, a dual-purpose circulating purifier in the present invention includes a housing 1, an oil fume purification device 2, a fresh air supply device 3, and a double-wing baffle device 4, where both the oil fume purification device 2 and the fresh air supply device 3 are arranged inside the housing 1; the oil fume purification device 2 is arranged above an indoor cooker and is configured to purify oil fume and exhaust air; the fresh air supply device 3 is arranged towards the outdoors and is configured to provide purified fresh air to the indoors; and the double-wing baffle device 4 is configured to block openings on two sides of the housing when the circulating purifier does not operate. It should be noted that, the dual-purpose circulating purifier may also be hoisted in an independent indoor space, that is, the dual-purpose circulating purifier may be used as a window-type purifier of suctioning from and discharging to the outdoors, or may be hoisted in any independent indoor space for use. The following provides a detailed description based on a window-type application for simply describing the technical solution.

The oil fume purification device 2 includes a fume suction opening 21, a first air outlet 22, a grease separator 23, a fume suction cavity 24, a first fan 25, a fume purification chamber 26, and a fume purification filter layer 27, where the fume suction opening 21 is disposed on an inner side of a lower part of the housing 1; the first air outlet 22 is disposed on an upper part of the housing 1; the grease separator 23 is disposed at the fume suction opening 21 or inside the fume suction cavity 24; and the fume purification filter layer 27 is disposed inside the fume purification chamber 26. The first fan 25 provides suction force to allow indoor oil fume and exhaust air to enter the fume suction cavity 24 through the fume suction opening 21. The oil fume and exhaust air first pass through the grease separator 23 to cause grease to be separated from fume. Fume is press-discharged to the fume purification chamber 26 through the first fan 25, and treated by the fume purification filter layer 27 for purification of all of fume particles, harmful gases, and peculiar smell in the fume, then discharged by the first air outlet 22, and what is discharged through the first air outlet 22 is harmless gas.

The fresh air supply device 3 includes an air suction opening 31, a second air outlet 32, a dust blocker 33, an air suction cavity 34, a second fan 35, a gas purification chamber 36, and a gas purification filter layer 37, where the air suction opening 31 is disposed on the lower part of the housing 1 and on an outer side facing away from the fume suction opening 21; the second air outlet 32 is disposed on an inner side of the upper part of the housing 1; the dust blocker 33 is disposed at the air suction opening 31 or inside the air suction cavity 34; and the gas purification filter layer 37 is disposed inside the gas purification chamber 36. The second fan 35 provides suction force to allow outdoor air to enter the air suction cavity 34 through the air suction opening 31; the dust blocker 33 separates dust from the air;

then the gas purification filter layer 37 further purifies the separated air; and finally through the second air outlet 32, clean fresh air is replenished to the indoors.

The first air outlet 22 and the second air outlet 32 are disposed on the upper part of the housing 1, and the fume suction opening 21 and the air suction opening 31 are disposed on the lower part of the housing 1, so as to implement smooth gas suction and discharge without mutual interference. When the circulating purifier is used as a window-type purifier, the first air outlet 22 discharges harmless gas to the outdoors, and the second air outlet 32 supplies fresh air to the indoors; when the circulating purifier is used for purifying indoor air, the first air outlet 22 and the second air outlet 32 disposed on the upper part of the housing 1 can face any direction. The oil fume purification device and the fresh air supply device carry out circulating purification of indoor polluted gas at the same time according to the foregoing working principle, so as to obtain fresh indoor air.

The fume suction cavity 24 and the air suction cavity 34 are integrally connected, and a partition plate 5 is disposed therebetween to form two mutually independent spaces. The first fan 25 and the second fan 35 are respectively disposed on two sides of the partition plate 5.

In an optional embodiment, the first fan 25 and the second fan 35 form a fan group and are driven by one motor; the fan group includes two volutes provided with wind wheels and a concentric motor 251 (351) with double output shafts that is shared by the two volutes; the two volutes are clamped on the partition plate 5; air inlets of the two volutes respectively face the fume suction opening and the air suction opening; the motor 251 (351) is longitudinally disposed on the partition plate 5; and the output shafts at two ends of the motor 251 (351) are respectively connected to the wind wheels inside the two volutes. Such single motor-driven suction and discharge structure with double wind wheels and double fume slots can not only implement bidirectional gas suction and gas discharge on respective channels, but also can make the whole machine operate smoothly with low noise and high energy efficiency.

In a first optional embodiment, the grease separator 23 is a mechanical grease separator, where the mechanical grease separator uses double layers of concave filter meshes, and respective concave surfaces of the filter meshes are oppositely buckled together. Grease mixed in fume forms a high speed swirling flow inside the filter meshes, grease particles reach a concave wall of the filter meshes by collision, and the grease particles are aggregated at and thus flowed down from there, so as to implement oil-gas separation.

In a second optional embodiment, the grease separator 23 is a radial multi-blade turnplate, where a center of the multi-blade turnplate is fastened to an end of the output shaft of the first fan, and the multi-blade turnplate is linked with the first fan and corresponds to the fume suction opening. A centrifugal effect of high speed rotation of the multi-blade turnplate and oil and gas collision is used to implement grease separation.

In a third optional embodiment, the grease separator 23 is an electrostatic grease separator, and an electrostatic field and a grease contact absorption unit are disposed inside the fume suction cavity, so as to separate grease from fume.

It should be noted that the foregoing listed three grease separators are also applicable to dust blocking, that is, the dust blocker 33 may use a technical solution that is the same as that used for the grease separator 23. A difference thereof lies in that, the dust blocker 33 is used for blocking dust particles, pollen, and other pollutants in the outdoor air, to implement preliminary filtering of external air before the external air enters the gas purification chamber. Further, for two sides of the dual-purpose circulating purifier that face different directions (that is, the side at which the oil fume purification device is disposed and the other side at which the fresh air supply device is disposed), a same manner or two different manners in the foregoing three technical solutions may be used, so as to implement both grease separation and dust blocking.

The fume purification filter layer 27 is one or a combination of several of an organic cotton filter mesh layer, a high efficiency HEPA mesh layer, an activated carbon filter layer, and nano photocatalyst $TiO_2$ layer, to purify or remove fume particles in oil fumes, and harmful gas and peculiar smell in fume. Similarly, the gas purification filter layer 37 may use a technical solution that is the same as that used for the fume purification filter layer 27.

The double-wing baffle device 4 uses double motors for driving, and includes a first baffle 411, a second baffle 421, a first push rod, a second push rod, a first motor, and a second motor, where an upper end of the first baffle 411 can be rotatably fastened above the fume suction opening through a hinge; one end of the first push rod is connected to the first baffle 411, and the other end thereof is directly or indirectly connected to the first motor. During operation, the first motor drives the first push rod, so that the first push rod pushes the first baffle 411 to be opened at a specific angle; the first baffle 411 covers on a cooker, rising oil fumes generated in cooking are blocked by the baffle in a negative pressure zone of the fume suction opening 21; and the oil fumes enter the fume suction cavity 24 under action of negative pressure of the fume suction opening 21, so as to effectively prevent flow of the oil fumes and enhance an absorption effect of the oil fume purification device. In a non-operating state, the first baffle 411 covers the fume suction opening, so as to not only prevent impurities from entering the fume suction cavity, but also provide a neat and beautiful appearance. An upper end of the second baffle 421 can be rotatably fastened above the air suction opening through a hinge; one end of the second push rod is connected to the second baffle 421, and the other end thereof is directly or indirectly connected to the second motor. During operation, the second motor drives the second push rod, so that the second push rod pushes the second baffle 421 to be opened at a specific angle, implementing protection in rain and snow days like a eave. In non-operating state, the second baffle 421 covers the air suction opening, so as to prevent impurities such as sand (especially bugs) from entering the air suction cavity.

As shown in FIG. 2, in an optional embodiment, the double-wing baffle device is of a single-motor structure, that is, one motor is used to drive an opening and closing mechanism of double-wing baffles, and the double-wing baffle device includes a first baffle 411, a second baffle 421, a first support rod 412, a second support rod 422, a first connecting rod 413, a second connecting rod 423, a first main drive rod 414, a first auxiliary drive rod 415, a second drive rod 424, a fixing seat 43, and a drive motor 44, where an upper end of the first baffle 411 can be rotatably fastened above the fume suction opening through a hinge; one end of the first support rod 412 is connected to the first baffle 411, and the other end thereof is connected to both one end of the first connecting rod 413 and one end of the first auxiliary drive rod 415; the other end of the first connecting rod 413 can be rotatably fastened to the fixing seat 43; the other end of the first auxiliary drive rod 415 is connected to one end of the first main drive rod 414; and the other end of the first main drive rod 414 is connected to the drive motor 44. When the drive motor 44 rotates a rotating shaft of the motor clockwise, the first main drive rod 414 also rotates clockwise and drives the first auxiliary drive rod 415 to move upwards; the first auxiliary drive rod 415 drives a connection point of the three rods to move upwards; and the first support rod 412 and the first connecting rod 413 tend to be straight. Because the other end of the first connecting rod 413 can be rotatably fastened to the fixing seat 43, the first support rod 412 can face only one direction, that is, the first baffle 411 is opened at a specific angle due to support of the first support rod 412. When the drive motor 44 rotates the rotating shaft of the motor anticlockwise, the first baffle 411 is withdrawn and covers the fume suction opening; an upper end of the second baffle 421 can be rotatably fastened above the air suction opening through a hinge; one end of the second support rod 422 is connected to the second baffle 421, and the other end thereof is connected to the second drive rod 424; and one end of the second connecting rod 423 can be rotatably fastened to the fixing seat 43, and the other end thereof is connected to the second support rod 422. When the drive motor 44 rotates the rotating shaft of the motor clockwise, the second drive rod 424 also rotates clockwise and drives one end of the second support rod 422 connected to the second drive rod 424 to move downwards. Because one end of the second connecting rod 423 can be rotatably fastened to the fixing seat 43, the second support rod 422 generates a seesaw effect, and the other end of the second support rod 422 moves upwards, that is, the second baffle 421 is opened at a specific angle due to support of the second support rod 422. When the drive motor 44 rotates the rotating shaft of the motor anticlockwise, the second baffle 421 is withdrawn and covers the air suction opening. It should be noted that opening/closing of the first baffle 411 and the second baffle 421 is driven by the drive motor 44, where a control circuit for maximum opening and closing positioning of the baffles can be implemented by timing control and overload protection control. Alternatively, manual opening and closing can be adopted when necessary.

The dual-purpose circulating purifier further includes a heat exchange device 6, where the heat exchange device 6 is a heat transfer system using tap water and cooling liquid as a heat conducting medium, is configured to raise temperature of gas entering the indoors during a cold season, and includes a heat absorber 61, a radiator 62, and a circulating pipeline 63, where the heat absorber 61 is arranged at a lower end of the circulating pipeline 63; and the radiator 62 is arranged at an upper end of the circulating pipeline 63; the heat absorber 61, the radiator 62, and the circulating pipeline 63 form a liquid circulation loop; the heat absorber 61 is arranged inside the fume suction cavity 24, and is configured to absorb heat of oil fumes; and the radiator 62 is arranged inside the fresh air supply device 3, and is configured to heat fresh air. In the cold season, tap water or cooling liquid is added to the liquid circulation loop, waste heat of oil fumes is absorbed by the heat absorber 61. According to a liquid level difference and temperature difference and a natural sinking principle, heat of liquid in the heat absorber 61 located below and the radiator 62 located higher is conducted and exchanged; fresh air input by the fresh air supply device 3 blows, to the indoors, heat released by the radiator 62. This not only compensates fresh air to the indoors, but also raises indoor temperature by conversion and recycling of heat generated in oil fumes. It should be noted that when tap water and cooling liquid is not added to the liquid circulation loop, due to the lack of an effective heat transfer medium, the radiator 62 does not heat fresh air.

To improve a heat exchange effect, a booster pump is disposed in the heat exchange device 6 when necessary. The booster pump is disposed to be connected to the circulating pipeline 63 to accelerate flow of tap water or cooling liquid, so as to promote heat exchange.

The heat absorber 61 and the radiator 62 each may be of a condenser structure and use a copper coil pipe, and multilayer fins are stacked in series on the coil pipe, so as to achieve good heat absorption and cooling efficiency.

The above description of the embodiment is only for helping to understand the method of the present invention and its core idea. It should be noted that, several improvements and modifications may be made by persons of ordinary skill in the art without departing from the principle of the present invention, and these improvements and modifications should also be considered within the protection scope of the present invention. Various modifications to these embodiments are readily apparent to persons skilled in the art, and the generic principles defined herein may be practiced in other embodiments without departing from the spirit or scope of the invention. Therefore, the present invention is not limited to the embodiments described herein but falls within the widest scope consistent with the principles and novel features disclosed herein.

What is claimed is:

1. A dual-purpose circulating purifier, comprising:

a housing, an oil fume purification device, a fresh air supply device, and a double-wing baffle device, wherein, both the oil fume purification device and the fresh air supply device are arranged inside the housing;

the oil fume purification device comprises a fume suction opening, a first air outlet, a grease separator, a fume suction cavity, a first fan, a fume purification chamber, and a fume purification filter layer;

the grease separator is disposed at the fume suction opening or inside the fume suction cavity, and the fume purification filter layer is disposed inside the fume purification chamber;

the fresh air supply device comprises an air suction opening, a second air outlet, a dust blocker, an air suction cavity, a second fan, a gas purification chamber, and a gas purification filter layer;

the dust blocker is disposed at the air suction opening or inside the air suction cavity, and the gas purification filter layer is disposed inside the gas purification chamber;

the double-wing baffle device comprises a first baffle and a second baffle, an upper end of the first baffle can be rotatably fastened above the fume suction opening, and an upper end of the second baffle can be rotatably fastened above the air suction opening;

the fume suction opening is disposed on an inner side of a lower part of the housing;

the first air outlet is disposed on an outer side of an upper part of the housing;

the air suction opening is disposed on the lower part of the housing and on an outer side facing away from the fume suction opening; and the second air outlet is disposed on an inner side of the upper part of the housing.

2. The dual-purpose circulating purifier according to claim 1, wherein the double-wing baffle device further comprises a first support rod, a second support rod, a first connecting rod, a second connecting rod, a first main drive rod, a first auxiliary drive rod, a second drive rod, a fixing seat, and a drive motor; one end of the first support rod is connected to the first baffle, and the other end thereof is connected to both one end of the first connecting rod and one end of the first auxiliary drive rod; the other end of the first connecting rod can be rotatably fastened to the fixing seat; the other end of the first auxiliary drive rod is connected to one end of the first main drive rod; the other end of the first main drive rod is connected to the drive motor; one end of the second support rod is connected to the second baffle, and the other end thereof is connected to the second drive rod; and one end of the second connecting rod can be rotatably fastened to the fixing seat, and the other end thereof is connected to the second support rod.

3. The dual-purpose circulating purifier according to claim 1, further comprising a heat exchange device, wherein the heat exchange device comprises a heat absorber, a radiator, and a circulating pipeline; the heat absorber is arranged at a lower end of the circulating pipeline and located inside the fume suction cavity; and the radiator is arranged at an upper end of the circulating pipeline and located inside the fresh air supply device.

4. The dual-purpose circulating purifier according to claim 1, wherein the fume suction cavity and the air suction cavity are integrally connected, and a partition plate is disposed therebetween.

5. The dual-purpose circulating purifier according to claim 4, wherein the first fan and the second fan are respectively disposed on two sides of the partition plate.

6. The dual-purpose circulating purifier according to claim 4, wherein the first fan and the second fan form a fan group; the fan group comprises two volutes provided with wind wheels and a concentric motor with double output shafts that is shared by the two volutes; the two volutes are clamped on the partition plate; the motor is longitudinally disposed on the partition plate; and the output shafts at two ends of the motor are respectively connected to the wind wheels inside the two volutes.

7. The dual-purpose circulating purifier according to claim 1, wherein the fume purification filter layer is one or a combination of several of an organic cotton filter mesh layer, a high efficiency HEPA mesh layer, an activated carbon filter layer, and nano photocatalyst $TiO_2$ layer; and the gas purification filter layer is one or a combination of several of an organic cotton filter mesh layer, a high efficiency HEPA mesh layer, an activated carbon filter layer, and nano photocatalyst $TiO_2$ layer.

8. A dual-purpose circulating purifier, comprising:

a housing, an oil fume purification device, a fresh air supply device, and a double-wing baffle device, wherein, both the oil fume purification device and the fresh air supply device are arranged inside the housing;

the oil fume purification device comprises a fume suction opening, a first air outlet, a grease separator, a fume suction cavity, a first fan, a fume purification chamber, and a fume purification filter layer;

the grease separator is disposed at the fume suction opening or inside the fume suction cavity, and the fume purification filter layer is disposed inside the fume purification chamber;

the fresh air supply device comprises an air suction opening, a second air outlet, a dust blocker, an air suction cavity, a second fan, a gas purification chamber, and a gas purification filter layer;

the dust blocker is disposed at the air suction opening or inside the air suction cavity, and the gas purification filter layer is disposed inside the gas purification chamber;

the double-wing baffle device comprises a first baffle and a second baffle, an upper end of the first baffle can be rotatably fastened above the fume suction opening, and an upper end of the second baffle can be rotatably fastened above the air suction opening; and the double-wing baffle device further comprises a first push rod, a second push rod, a first motor, and a second motor, one end of the first push rod is connected to the first baffle, and one end of the second push rod is connected to the second baffle.

9. A dual-purpose circulating purifier, comprising:

a housing, an oil fume purification device, a fresh air supply device, and a double-wing baffle device, wherein, both the oil fume purification device and the fresh air supply device are arranged inside the housing;

the oil fume purification device comprises a fume suction opening, a first air outlet, a grease separator, a fume suction cavity, a first fan, a fume purification chamber, and a fume purification filter layer;

the grease separator is disposed at the fume suction opening or inside the fume suction cavity, and the fume purification filter layer is disposed inside the fume purification chamber;

the fresh air supply device comprises an air suction opening, a second air outlet, a dust blocker, an air suction cavity, a second fan, a gas purification chamber, and a gas purification filter layer;

the dust blocker is disposed at the air suction opening or inside the air suction cavity, and the gas purification filter layer is disposed inside the gas purification chamber;

the double-wing baffle device comprises a first baffle and a second baffle, an upper end of the first baffle can be rotatably fastened above the fume suction opening, and an upper end of the second baffle can be rotatably fastened above the air suction opening; and the heat exchange device further comprises a booster pump, and the booster pump is connected to the circulating pipeline.

* * * * *